US011233300B2

(12) United States Patent
Pollock

(10) Patent No.: US 11,233,300 B2
(45) **Date of Patent: *Jan. 25, 2022**

(54) WAVEGUIDE CONNECTOR ASSEMBLY ENGAGEABLE WITH A WAVEGUIDE TO PERMIT POLARIZATION ROTATION OF THE WAVEGUIDE, AND AN ANTENNA FORMED THEREFROM

(71) Applicant: Transtector Systems, Inc., Hayden, ID (US)

(72) Inventor: Justin G. Pollock, Edmonton (CA)

(73) Assignee: INFINITE ELECTRONICS INTERNATIONAL, INC., Hayden, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/837,922

(22) Filed: Apr. 1, 2020

(65) Prior Publication Data

US 2020/0235448 A1 Jul. 23, 2020

Related U.S. Application Data

(63) Continuation of application No. 15/951,924, filed on Apr. 12, 2018, now Pat. No. 10,651,523.

(51) Int. Cl.

| | |
|---|---|
| ***H01P 1/165*** | (2006.01) |
| ***H01P 1/04*** | (2006.01) |
| ***H01P 3/12*** | (2006.01) |
| ***H01P 1/06*** | (2006.01) |
| ***H01Q 13/02*** | (2006.01) |
| ***H01Q 19/19*** | (2006.01) |
| ***H01Q 1/12*** | (2006.01) |

(52) U.S. Cl.

CPC ..... *H01P 1/165* (2013.01); *H01P 1/042* (2013.01); *H01P 1/06* (2013.01); *H01P 3/12* (2013.01); *H01Q 1/1207* (2013.01); *H01Q 13/02* (2013.01); *H01Q 19/193* (2013.01)

(58) Field of Classification Search

CPC ..... H01P 1/042; H01P 5/024; H01P 1/165
USPC ..... 333/255, 254
See application file for complete search history.

(56) References Cited

U.S. PATENT DOCUMENTS

| | | | |
|---|---|---|---|
| 2,859,052 | A | 11/1954 | Corbeels et al. |
| 2,892,987 | A | 2/1955 | Cedrone |
| 3,076,948 | A | 2/1963 | Misner |
| 3,221,279 | A | 1/1965 | Gross |
| 3,821,670 | A | 6/1974 | Thompson |
| 4,247,838 | A | 1/1981 | Sirel |

(Continued)

*Primary Examiner* — Benny T Lee
(74) *Attorney, Agent, or Firm* — Snell & Wilmer LLP

(57) ABSTRACT

The waveguide connector assembly includes a waveguide connector having a first end, a second end, and a body having an interior surface and an exterior surface, the waveguide connector being configured to receive a waveguide in a first orientation or a second orientation at the first end, the second orientation being a rotation of the waveguide from the first orientation by either 45 degrees or 90 degrees to change polarizations. The waveguide connector assembly includes a movable sleeve having a first end, a second end, a body, and an engaging surface, the movable sleeve being configured to slide axially along the exterior surface of the waveguide connector, the engaging surface being configured to prevent axial movement of the waveguide when the movable sleeve is in an engaged position.

20 Claims, 7 Drawing Sheets

(56) References Cited

U.S. PATENT DOCUMENTS

| | | | | |
|---|---|---|---|---|
| 4,623,658 | A | 11/1986 | Montesanto et al. | |
| 4,763,132 | A | 8/1988 | Juds et al. | |
| 4,962,991 | A | 10/1990 | Carvalho | |
| 6,507,324 | B2 | 1/2003 | Overton et al. | |
| 9,225,071 | B2 | 12/2015 | Lee et al. | |
| 10,651,523 | B2 * | 5/2020 | Pollock | H01Q 19/193 |
| 2004/0263291 | A1 | 12/2004 | Corkill et al. | |
| 2005/0285702 | A1 | 12/2005 | Graczyk et al. | |
| 2016/0104929 | A1 | 4/2016 | Taptic et al. | |

* cited by examiner

WAVEGUIDE CONNECTOR ASSEMBLY ENGAGEABLE WITH A WAVEGUIDE TO PERMIT POLARIZATION ROTATION OF THE WAVEGUIDE, AND AN ANTENNA FORMED THEREFROM

CROSS-REFERENCE TO RELATED APPLICATIONS

This application is continuation of U.S. patent application Ser. No. 15/951,924, entitled "A Waveguide Connector Assembly Having Bearings Engageable By A Movable Sleeve To Allow Or Prevent Axial Movement Of The Connector Assembly, And An Antenna And A Polarizer, Respectively Formed Therefrom," filed on Apr. 12, 2018, now U.S. Pat. No. 10,651,523, which issued on May 12, 2020, the contents of which are herein incorporated by reference in its entirety.

BACKGROUND

1. Field of the Invention

The present invention relates to a waveguide connector assembly and more particularly to a waveguide connector assembly with a waveguide connector and a moveable sleeve.

2. Description of the Related Art

Waveguide connectors provide an electrical and mechanical connection between a wireless transmitter/receiver and an antenna. Current waveguide connectors provide this connection through the use of flanges and a plurality of fasteners. The waveguide connection must be disassembled and assembled repeatedly and thus requires the use of specialized tools and many small parts. This configuration presents a problem for waveguide connectors mounted on difficult to reach locations such as tall buildings and antenna towers. Accordingly, there is a need for a quick connect waveguide assembly.

SUMMARY OF THE INVENTION

A waveguide connector assembly is disclosed. The waveguide connector assembly includes a waveguide connector having a first end, a second end opposite the first end, and a body having a length that extends axially between the first end and the second end, the body having an interior surface and an exterior surface, the waveguide connector being configured to receive a waveguide in a first orientation or a second orientation at the first end, the second orientation being a rotation of the waveguide from the first orientation by either 45 degrees or 90 degrees to change polarizations. The waveguide connector assembly also includes a movable sleeve having a first end, a second end opposite the first end, a body extending axially between the first end and the second end, and an engaging surface, the movable sleeve being configured to slide axially along the exterior surface of the waveguide connector, the engaging surface being configured to prevent axial movement of the waveguide when the movable sleeve is in an engaged position.

An antenna system is disclosed. The antenna system includes an antenna. The antenna system further includes a waveguide. The antenna system further includes a connector assembly. The connector assembly further includes a waveguide connector having a first end, a second end opposite the first end, and a body having a length that extends axially between the first end and the second end, the body having an interior surface and an exterior surface, the waveguide connector being configured to receive the waveguide in a first orientation or a second orientation at the first end, the second orientation being a rotation of the waveguide from the first orientation by either 45 degrees or 90 degrees to change polarizations. The connector assembly also includes a movable sleeve having a first end, a second end opposite the first end, a body extending axially between the first end and the second end, and an engaging surface, the movable sleeve being configured to slide axially along the exterior surface of the waveguide connector, the engaging surface being configured to prevent axial movement of the waveguide when the movable sleeve is in the engaged position. The antenna system further includes a bracket configured to couple the connector assembly to the antenna.

A method of adjusting the polarizations of a waveguide connector assembly is disclosed. The method includes releasing a waveguide from a waveguide connector to allow free movement of the waveguide by sliding a movable sleeve on the waveguide connector away from an engaged position along an axis. The method also includes rotating a waveguide either 45 degrees or 90 degrees. The method also includes securing the waveguide to the waveguide connector to prevent free movement of the waveguide by sliding the movable sleeve towards the engaged position along the axis.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION OF THE INVENTION

In the following detailed description, numerous specific details are set forth to provide an understanding of the present disclosure. It will be apparent, however, to one of ordinary skill in the art that elements of the present disclosure may be practiced without some of these specific details. In other instances, well-known structures and techniques have not been shown in detail to avoid unnecessarily obscuring the present disclosure.

Figure 1A:
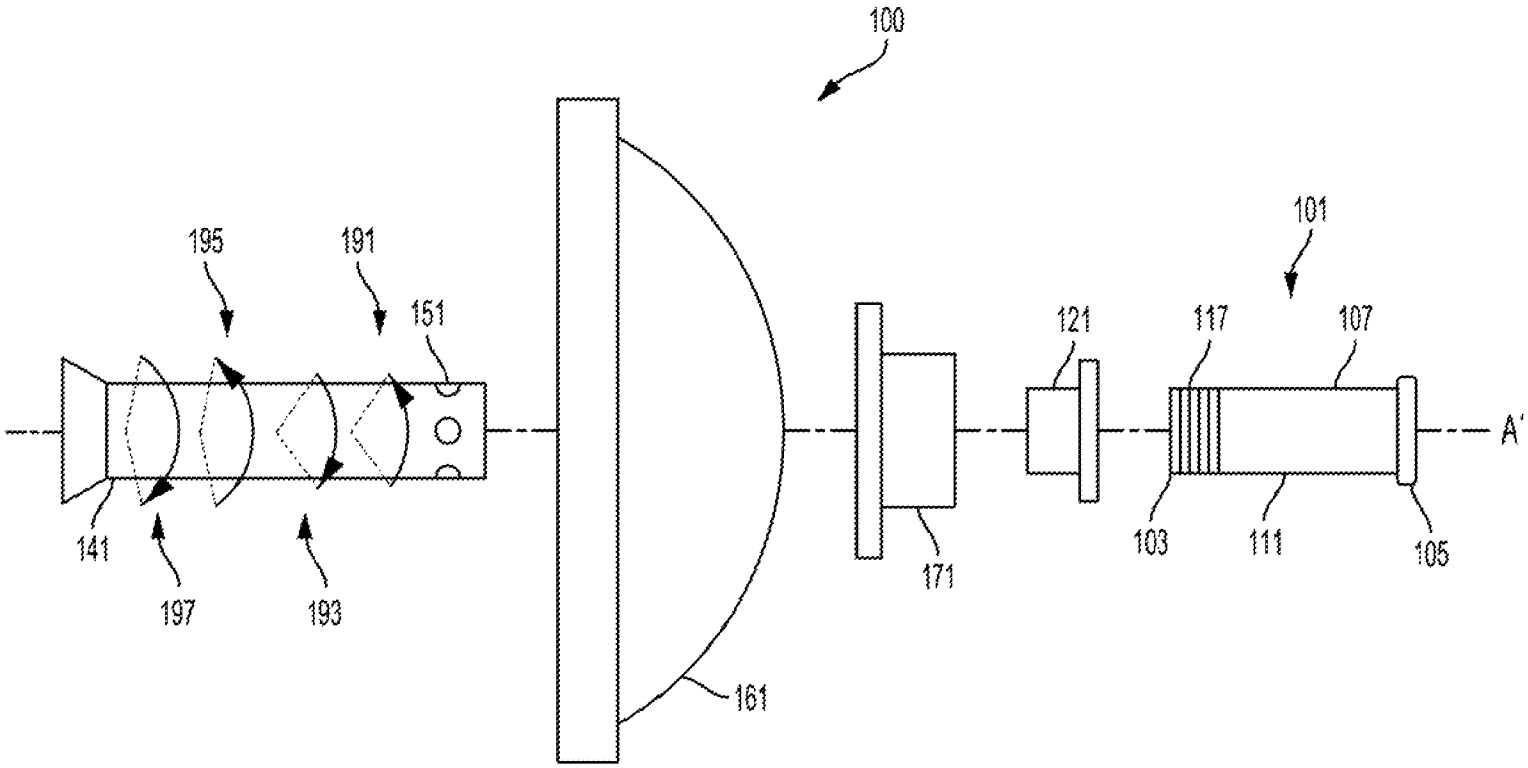
FIG. 1A is an exploded side view of an antenna system according to an embodiment of the invention.

FIG. 1A is an exploded side view of an antenna system 100 with a waveguide connector 101, a movable sleeve 121, a waveguide 141, an antenna 161, and a bracket 171 according to an embodiment of the invention.

Waveguide connector 101 may have a first end 103, a second end 105 opposite first end 103, a body 107 having a length that extends along an axis A' between first end 103 and second end 105, an exterior surface 111, and a mating surface 117. Waveguide connector 101 may be configured to receive waveguide 141 at first end 103 through antenna 161 and through bracket 171. Waveguide 141 may have one or more nesting surfaces 151 to aid in waveguide connector 101 receiving waveguide 141.

Movable sleeve 121 may be configured to slide axially on exterior surface 111 of waveguide connector 101. Movable sleeve 121 may have an actuating surface (or "engaging surface") configured to prevent axial movement of waveguide 141 when movable sleeve 121 is in an actuating position (or "engaged position"). As used herein, "actuating position" or "engaged position" refers to an axial position of movable sleeve 121 relative to waveguide connector 101 which causes waveguide connector 101 to engage with waveguide 141.

Bracket 171 may be configured to couple to antenna 161 and likewise be configured to couple to waveguide connector 101 via mating surface 117. In its fully assembled form or configuration, waveguide 141 is received by waveguide connector 101, antenna 161 is coupled to waveguide connector 101 via bracket 171, and movable sleeve 121 secures waveguide 141 to waveguide connector 101.

A user may remove waveguide 141 from antenna system 100, without the usage of tools, by sliding movable sleeve 121 away from the actuating position and sliding waveguide 141 axially away from waveguide connector 101. A user may attach waveguide 141 to antenna 161 and waveguide connector 101, without the usage of tools, by sliding movable sleeve 121 away from the actuating position, sliding waveguide 141 axially towards and through antenna 161 and into waveguide connector 101, and then sliding movable sleeve 121 back into the actuating position.

A user may also adjust the polarity of antenna system 100, without the usage of tools, by sliding movable sleeve 121 away from the actuating position, sliding waveguide 141 axially away from antenna 161, rotating waveguide 141 (e.g., rotating by 45 degrees or 90 degrees), sliding waveguide 141 axially towards and through antenna 161 and into waveguide connector 101, and then sliding movable sleeve 121 back into the actuating position. That is, the waveguide 141 may be rotated in a first direction 191 by 45 degrees, rotated in a second direction 193 opposite to the first direction 191 by 45 degrees, rotated in the first direction 195 by 90 degrees, and rotated in the second direction 197 by 90 degrees.

Antenna 161 is depicted as a parabolic dish, however, other configurations such as a horn, an open aperture, a reflector, or a subreflector may be used interchangeably according to various embodiments.

Figure 1B:
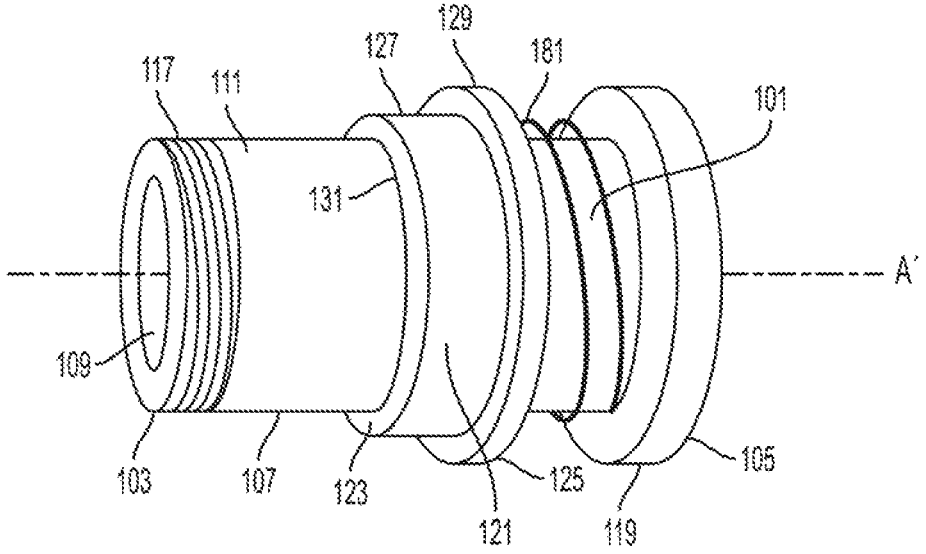
FIG. 1B is a side perspective view of the waveguide connector and movable sleeve of FIG. 1A according to an embodiment of the invention.

FIG. 1B is a side perspective view of the waveguide connector 101 and movable sleeve 121 of FIG. 1A according to an embodiment of the invention.

Waveguide connector 101 has a first end 103, a second end 105 opposite first end 103, and a body 107 having a length that extends along an axis A' between first end 103 and second end 105. Body 107 of waveguide connector 101 has an interior surface 109 and an exterior surface 111. Body 107 may have various cross sectional geometries, for example, cylindrical, rectangular, square, or otherwise rotational symmetric.

In some embodiments, interior surface 109 of body 107 is symmetrical in cross section throughout the length of body 107. In other embodiments, the cross sectional geometry of waveguide connector 101 may vary along the length of body 107.

In some embodiments, interior surface 109 may couple to or form indexing surfaces to aid a user in aligning waveguide 141, as shown in FIG. 1A, in relation to waveguide connector 101 as waveguide 141 is being inserted into waveguide connector 101. The indexing surfaces may be in the form of rails, interior protrusions, grooves, or any other surface configuration that may aid a user in the alignment of waveguide 141 in relation to waveguide connector 101. In some embodiments, the indexing surfaces may span the length of body 107. In some embodiments, the indexing surfaces may begin at first end 103 of waveguide connector 101 and may extend only partially through the length of body 107.

As shown in FIGS. 1A and 1B, a mating surface 117 may be present along a portion of body 107. While mating surface 117 is depicted as being proximal to first end 103 and on exterior surface 111, in other embodiments, mating surface 117 may be located anywhere else. In some embodiments, mating surface 117 may be located proximal to second end 105. In some embodiments, mating surface 117 may be formed on interior surface 109.

In some embodiments, mating surface 117 may be configured to mate with bracket 171, which is connected to antenna 161, as shown in FIG. 1A. In some embodiments, mating surface 117 may be configured to mate with a collar, which is connected to antenna 161. In some embodiments, mating surface 117 may be configured to mate with a collar, which is connected to bracket 171. In some embodiments, mating surface 117 may be configured to mate directly with antenna 161.

First end 103 of waveguide connector 101 may be configured to receive waveguide 141, as shown in FIG. 1A. Waveguide 141 may be in the form of a waveguide feed or a waveguide launcher. In some embodiments, second end 105 of waveguide connector 101 may also be configured to receive a second waveguide. In these embodiments, second end 105 may have features similar to first end 103 for connecting second end 105 to a second waveguide.

As shown in FIG. 1B, waveguide connector 101, in some embodiments, may have flange 119 extending radially outward from body 107. Flange 119 may be located proximal to second end 105 of waveguide connector 101. In other embodiments, flange 119 may be located proximal to first end 103 of waveguide connector 101. Flange 119 may be configured to aid a user in gripping waveguide connector 101 when waveguide connector 101 is being moved axially along exterior surface 111. Flange 119 may also prevent movable sleeve 121 from sliding off of waveguide connector 101. Flange 119 may be integral to or permanently attached to waveguide connector 101. In other embodiments, flange 119 may be removably coupled to waveguide connector 101.

Movable sleeve 121 has a first end 123, a second end 125 opposite first end 123, and a body 127 having a length that extends along the axis A' between first end 123 and second end 125. Movable sleeve 121 is configured to slide axially along exterior surface 111 of waveguide connector 101. Movable sleeve 121 may have an actuation surface 131 that is configured to prevent axial movement of a waveguide 141 when movable sleeve 121 is in an actuating position and securing waveguide 141, as shown in FIG. 1A, to waveguide connector 101.

In some embodiments, actuating surface 131 may be an inner flange extending radially inward. In some embodiments, actuating surface 131 may be one or more inner protrusions extending at least partially radially inward. In some embodiments, actuating surface 131 may be a surface of higher friction than the rest of body 127. In some embodiments, actuating surface 131 may be made of a material that emits a magnetic force.

Figure 1C:
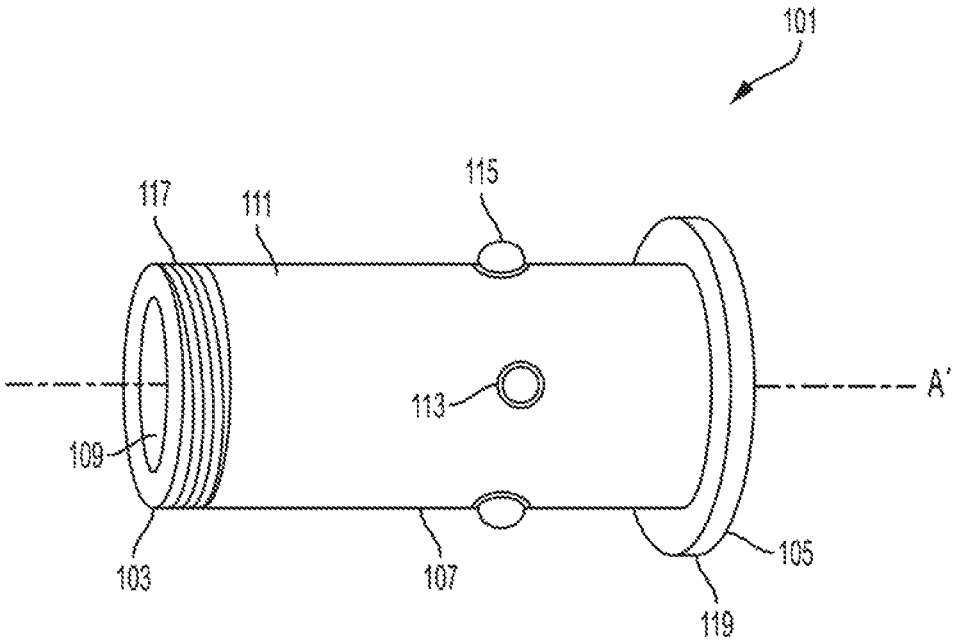
FIG. 1C is a side perspective view of the waveguide connector of FIGS. 1A and 1B according to an embodiment of the invention.

In some embodiments, when movable sleeve 121 is in the actuating position, actuation surface 131 may be configured to interact with a bearing coupled to waveguide connector 101. FIG. 1C illustrates bearing 115 used to prevent axial movement of waveguide 141 shown in FIG. 1A. Bearing 115 may nest in the one or more nesting surfaces 151 of waveguide 141, as shown in FIG. 1A, and prevent axial movement of the waveguide when bearing 115 is restricted in its radial movement by movable sleeve 121 shown in FIGS. 1A and 1B being in the actuating position. That is, when movable sleeve 121 is placed in the actuating position, actuating surface 131 shown in FIG. 1B may interact with the bearing to prevent radial movement of the bearing. In some embodiments, actuation surface 131 may be similarly configured to interact with various forms of bearings, detents, plungers, compressible rings, partial rings, washers, buttons, pins, or stops to prevent axial movement of the waveguide when movable sleeve 121 is in an actuating position.

Referring back to FIG. 1A, nesting surfaces 151 may be configured to couple to any configuration of bearings, detents, plungers, compressible rings, partial rings, washers, buttons, pins, or stops when movable sleeve 121 is in the actuating position. Waveguide 141 may have additional nesting surfaces configured to allow waveguide 141 to be received by waveguide connector 101 and coupled to any of the above mentioned configurations when waveguide 141 has been rotated 45 degrees or 90 degrees. Waveguide 141 may be rotated in order to change the polarizations. In some embodiments, waveguide 141 may be rotated while it is received by waveguide connector 101. In some embodiments, waveguide 141 may be rotated only after the waveguide 141 has been first removed from waveguide connector 101.

In some embodiments, a force provider 181, as shown in FIG. 1B, may be coupled to movable sleeve 121 and may provide a force urging movable sleeve 121 towards the actuating position. Force provider 181 may also be coupled to flange 119. Force provider 181 may be configured such that when a user slides movable sleeve 121 away from the actuating position, force provider 181 provides an urging force to return movable sleeve 121 back to the actuating position. Force provider 181 may be in the form of a mechanical spring, a pneumatic spring, a hydraulic spring, a magnetic spring, or an electromagnetic spring. Force provider 181 is depicted as being located proximal to second end 105 but can also be located proximal to first end 103.

As shown in FIG. 1B, to better facilitate a user's interaction with movable sleeve 121, movable sleeve 121 may have a gripping surface 129. Gripping surface 129 may be configured to aid a user in moving movable sleeve 121 either away from or towards an actuating position. In some embodiments, gripping surface 129 may be a flange extending radially outward from body 127. Gripping surface 129 may be formed throughout an exterior surface of body 127 of movable sleeve 121. In some embodiments, gripping surface 129 may be formed only partially on the exterior surface of body 127 of movable sleeve 121. Gripping surface 129 may be in the form of a protrusion on the exterior surface of body 127.

In some embodiments, movable sleeve 121 may have the same cross sectional geometry as waveguide connector 101. In some embodiments, movable sleeve 121 may have a different cross sectional geometry than waveguide connector 101. In some embodiments, movable sleeve 121 may have a cross sectional geometry that varies along the length of movable sleeve 121.

Figure 1D:
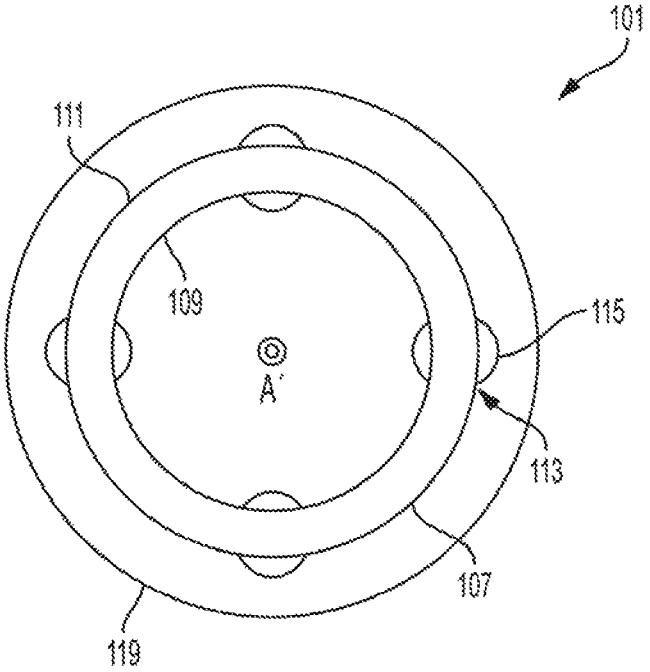
FIG. 1D is a front view of the waveguide connector of FIGS. 1A, 1B, and 1C according to an embodiment of the invention.

FIGS. 1C and 1D illustrate different views of waveguide connector 101. Waveguide connector 101 may have an aperture 113 that is configured to couple to bearing 115. In some embodiments there can be only a single bearing in a bearing set. In some embodiments, there can be a plurality of bearings in the bearing set and a plurality of corresponding apertures coupled to the bearings in the bearing set. In some embodiments, aperture 113 couples to bearing 115 by having body 107 crimped around bearing 115. In some embodiments, aperture 113 may be a varying diameter cutout of body 107 such that the diameter of the cutout is smaller on interior surface 109 of waveguide connector 101 than on exterior surface 111 of waveguide connector 101. Apertures 113 may be configured to allow a portion of bearing 115 to extend radially inward inside waveguide connector 101 as depicted in FIG. 1C.

In some embodiments, aperture 113 couples to bearing 115 by having a retainer coupled to exterior surface 111 of waveguide connector 101. The retainer may be coupled to exterior surface 111 via a brazing, an adhesive, or fastening using fasteners. In some embodiments, aperture 113 couples to bearing 115 by having a retainer coupled to interior surface 109 of waveguide connector 101. The retainer may be coupled to interior surface 109 by a brazing, an adhesive, or fastening using fasteners.

Bearing 115 may be coupled to a force provider to provide a restoring force urging it away from a nesting position. The force provider may be a mechanical spring, a pneumatic spring, a hydraulic spring, a magnetic spring, or an electromagnetic spring. In some embodiments, aperture 113 may be similarly configured to couple to detents, plungers, compressible rings, partial rings, washers, buttons, pins, or stops.

In some embodiments, actuating surface 131 shown in FIG. 1B may be configured to prevent radial movement of bearing 115 when actuating surface 131 covers aperture 113. When movable sleeve 121 shown in FIG. 1B is brought to the actuating position, actuating surface 131 may depress bearing 115 and force bearing 115 radially inward engaging the nesting surface on the waveguide 141 shown in FIG. 1A. In some embodiments, bearing 115 may be forced away from the nesting surface on the waveguide 141 shown in FIG. 1A by a force provider coupled to waveguide connector 101 when the movable sleeve 121 is not in the actuating position, to facilitate disengagement of waveguide 141 shown in FIG. 1A from the waveguide connector 101. The force provider may be a mechanical spring, a pneumatic spring, a hydraulic spring, a magnetic spring, or an electromagnetic spring. It should be understood that any configurations of detents, plungers, compressible rings, partial rings, washers, buttons, pins, or stops may be substituted for bearing 115 discussed in any of the embodiments.

In some embodiments, interior surface 109 of waveguide connector 101 and/or an exterior surface of waveguide 141 may have a coating or a plating for reducing wear or friction caused by the insertion and removal of waveguide 141. In some embodiments, exterior surface 111 of waveguide connector 101 and/or an interior surface of movable sleeve 121 may have a coating or plating for reducing wear or friction caused by the sliding of movable sleeve 121 over exterior surface 111 of waveguide connector 101.

In some embodiments, any combination of the surfaces of waveguide connector 101, movable sleeve 121, or waveguide 141, may have a coating or a plating for enhancing its resistance to corrosion. In some embodiments, any combination of the surfaces of waveguide connector 101, movable sleeve 121, or waveguide 141, may have a coating or a plating for enhancing its electrical properties.

Figure 2A:
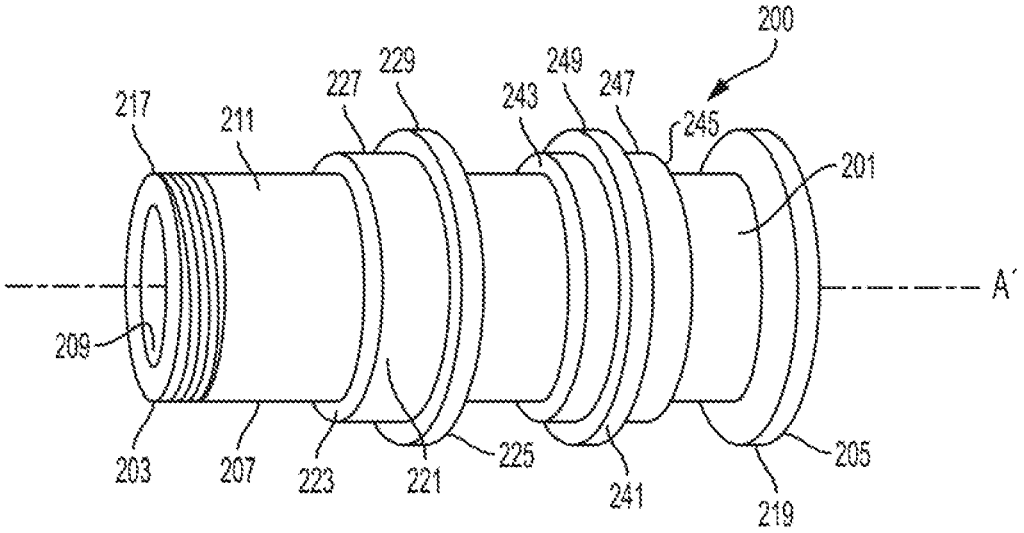
FIG. 2A is a side perspective view of a waveguide connector assembly with a waveguide connector, a first movable sleeve, and a second movable sleeve according to an embodiment of the invention.
Figure 2B:
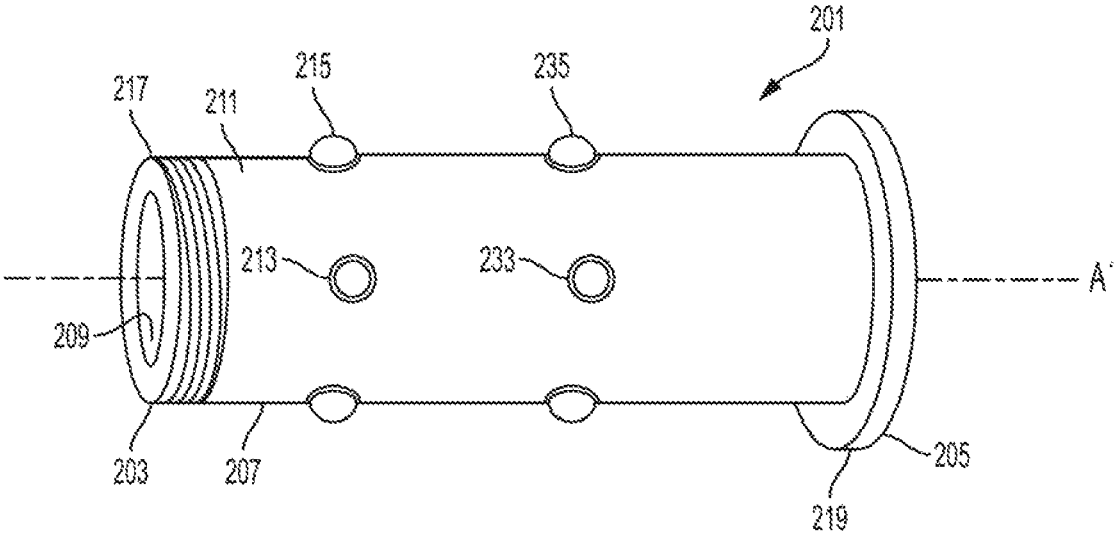
FIG. 2B is a side perspective view of the waveguide connector of FIG. 2A according to an embodiment of the invention.

FIG. 2A is a side perspective view of a waveguide connector assembly 200 with a waveguide connector 201, a first movable sleeve 221, and a second movable sleeve 241. As shown in FIGS. 2A and 2B, the waveguide connector 201 includes a first end 203 (similar to first end 103 as shown in FIGS. 1A-1C), a second end 205 (similar to second end 105 as shown in FIGS. 1A-1C) opposite first end 203, a body 207 (similar to body 107 as shown in FIGS. 1A-1D) having a length that extends along an axis A' between first end 203 and second end 205, an exterior surface 211 (similar to exterior surface 111 as shown in FIGS. 1A-1D), and a mating surface 217 (similar to mating surface 117 as shown in FIGS. 1A-1C). Body 207 has an interior surface 209 (similar to interior surface 109 as shown in FIGS. 1B-1D). Waveguide connector 201, in some embodiments, may have flange 219 (similar to flange 119 as shown in FIGS. 1B-1D) extending radially outward from body 207. Returning to FIG. 2A, the first movable sleeve 221 has a first end 223, a second end 225 opposite first end 223, and a body 227 having a length that extends along the axis A' between first end 223 and second end 225. The first movable sleeve 221 also has a gripping surface 229 (similar to gripping surface 129 as shown in FIG. 1B). Second movable sleeve 241 has a first end 243, a second end 245 opposite first end 243, and a body 247 having a length that extends along the axis A' between first end 243 and second end 245.

Waveguide connector 201 is similar to waveguide connector 101 depicted in FIGS. 1A-1D except waveguide connector 201 is configured to receive a second waveguide at second end 205. First moveable sleeve 221 is likewise similar to movable sleeve 121 depicted in FIG. 1B. Second movable sleeve 241 operates similarly to first moveable sleeve 221 depicted in FIG. 1B. Second movable sleeve 241 is also configured to slide axially along exterior surface 211 of waveguide connector 201. Second moveable sleeve 241 also has an actuating surface being configured to prevent axial movement of the second waveguide when second moveable sleeve 241 is in actuating position.

To better facilitate a user's interaction with second movable sleeve 241, second movable sleeve 241 may also have a gripping surface 249. Gripping surface 249 may be configured to aid a user in moving movable sleeve 241 away and towards an actuating position. In some embodiments, gripping surface 249 may be configured to aid a user in moving movable sleeve 241 either away or towards an actuation position. In some embodiments, gripping surface 249 may be a flange extending radially outward from body 247. Gripping surface 249 may be formed throughout an exterior surface of body 247. In some embodiments, gripping surface 249 may be formed only partially on the exterior surface of body 247. In some embodiments, gripping surface 249 may be in the form of a protrusion on the exterior surface of body 247.

FIG. 2B is a side perspective view of waveguide connector 201 of FIG. 2A without movable sleeve 221 and movable sleeve 241 as shown in FIG. 2A according to an embodiment. Waveguide connector 201 is similar to waveguide connector 101 depicted in FIGS. 1A-1D except for the addition of an additional aperture 233 within a set of apertures and a bearing 235 within a bearing set for engaging a nesting surface on the second waveguide. That is, waveguide connector 201 includes a first set of apertures 213 (similar to aperture 113 as shown in FIGS. 1C and 1D) and a second set of apertures 215 (similar to aperture 115 as shown in FIGS. 1C and 1D). It should be understood that any configurations of detents, plungers, compressible rings, partial rings, washers, buttons, pins, or stops may be substituted for bearing 235 discussed in any of the embodiments.

Figure 3:
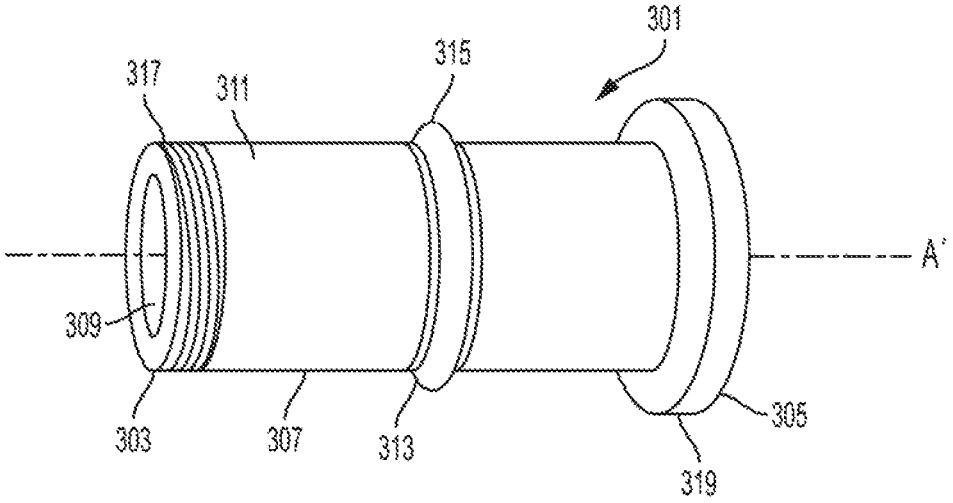
FIG. 3 is a side perspective view of a waveguide connector according to an embodiment of the invention.

FIG. 3 is a side perspective view of waveguide connector 301 according to an embodiment. Waveguide connector 301 is similar to waveguide connector 101 depicted in FIGS. 1A-1D except waveguide connector 301 has channel 313 instead of aperture 113 shown in FIG. 1D. Waveguide connector 301 has a first end 303, a second end 305 opposite first end 303, and has a body 307 having a length that extends along an axis A' between first end 303 and second end 305. Body 307 of waveguide connector 301 has an interior surface 309 and an exterior surface 311. Waveguide connector 301 has a channel 313 in the form of an annular recess configured to couple to a compressible ring 315. In some embodiments, an actuating surface from a movable sleeve may force the compressible ring 315 radially inward to couple to a nesting surface of the waveguide when the movable sleeve is brought to an actuating position. Waveguide 301 may have mating surface 317 and flange 319 equivalent to mating surface 117 and flange 119 in FIGS. 1B-1D.

Figure 4A:
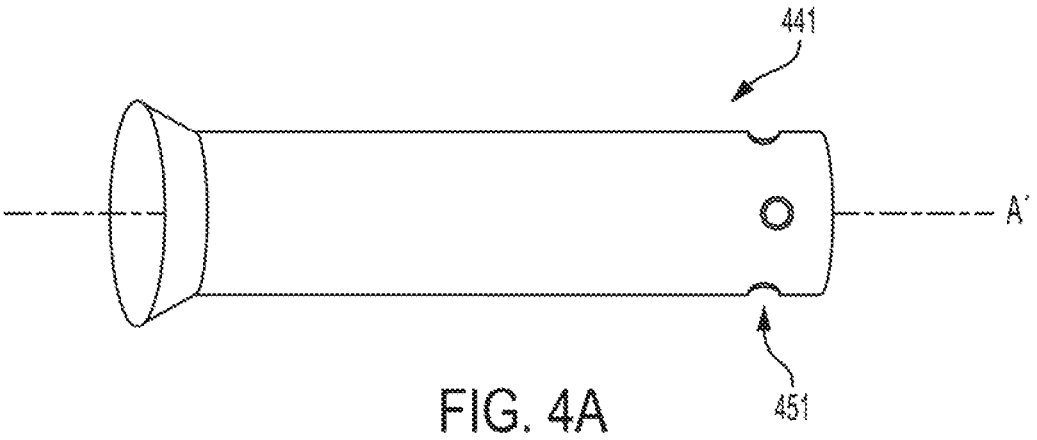
FIG. 4A is a side perspective view of a waveguide according to an embodiment of the invention.
Figure 4B:
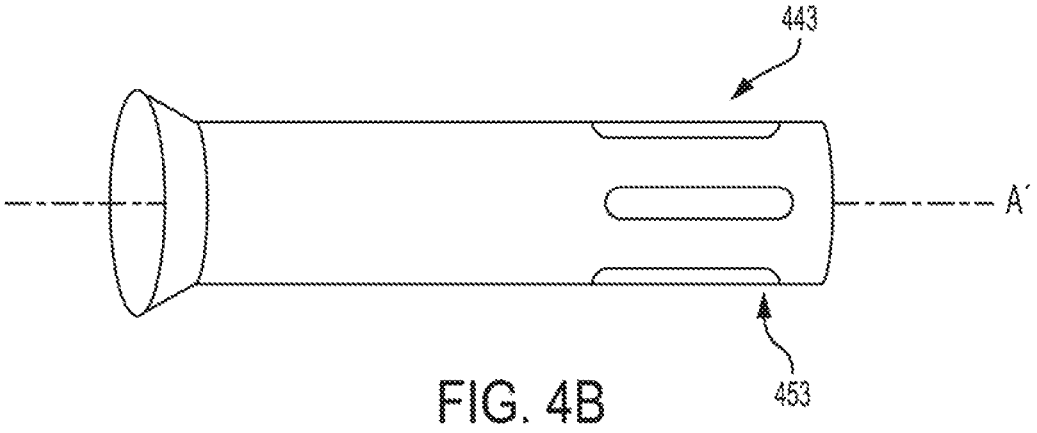
FIG. 4B is a side perspective view of a waveguide according to an embodiment of the invention.
Figure 4C:
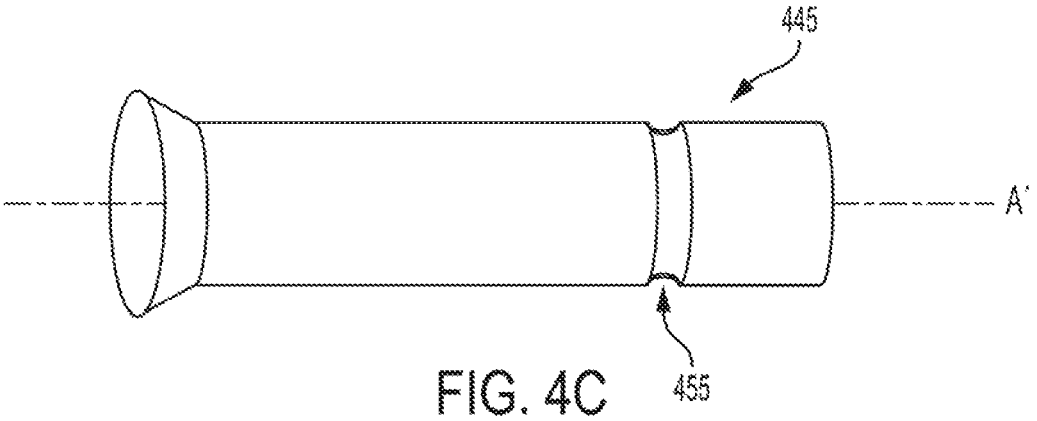
FIG. 4C is a side perspective view of a waveguide according to an embodiment of the invention.

FIGS. 4A-4C are side perspective views of waveguides according to various embodiments. FIG. 4A illustrates a waveguide 441 having a nesting surface including recesses 451 configured to couple with an interior surface of a waveguide connector having bearings. FIG. 4B illustrates a waveguide 443 having a nesting surface including grooves 453 configured to couple with an interior surface of a waveguide connector having bearings with additional axial distance for adjustment. FIG. 4C illustrates a waveguide 445 having a nesting surface including an annular recess 455 configured to couple with an interior surface of a waveguide connector having a compressible ring. In some embodiments, the nesting surface may be configured to couple with a waveguide connector after the waveguide has been rotated either 45 degrees or 90 degrees.

Figure 5:
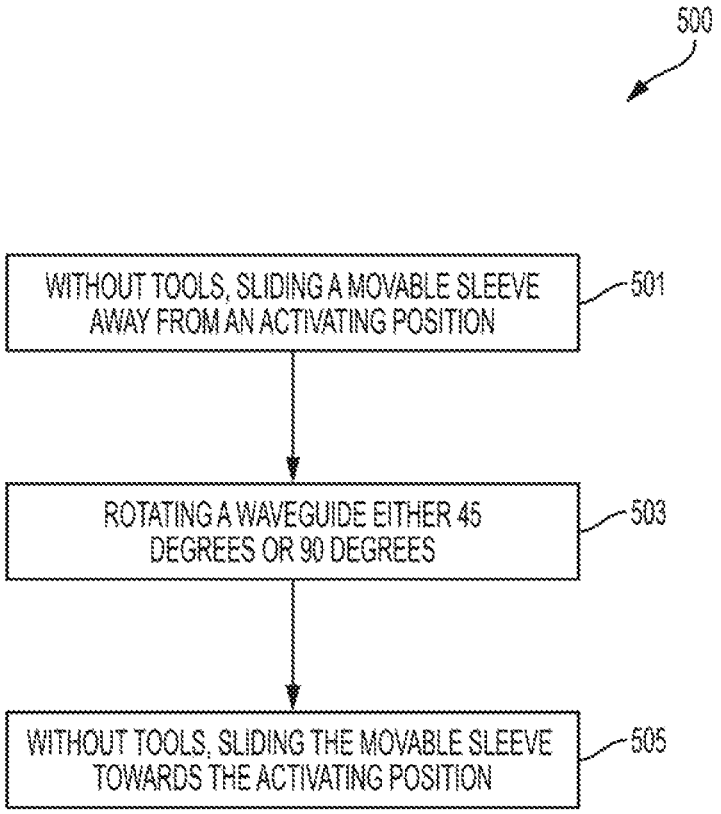
FIG. 5 is a flowchart for a method of adjusting the polarizations of a waveguide connector assembly according to an embodiment of the invention.

FIG. 5 is a flowchart 500 for a method of adjusting the polarizations of a waveguide connector assembly according to an embodiment. A benefit of the waveguide connector described herein is the ease of connecting and disconnecting a waveguide. An example use of this ease of connecting and disconnecting is adjusting the polarity of the waveguide.

Without tools, a user may slide a movable sleeve (e.g. movable sleeve 121 in FIGS. 1A and 1B) away from an actuating position (Step 501). When the movable sleeve is moved away from the actuating position a waveguide (e.g. waveguide 141 shown in FIG. 1A) may be decoupled from a waveguide connector (e.g. waveguide connector 101 shown in FIG. 1A), thereby allowing axial movement of the waveguide relative to the waveguide connector. In some embodiments, the waveguide may be free to rotate within the waveguide connector when the waveguide is decoupled from the waveguide connector.

A user may then rotate the waveguide either 45 degrees or 90 degrees (Step 503). In some embodiments, the waveguide may be removed from the waveguide connector prior to a user rotating it. In some embodiments, the waveguide may be still within the waveguide connector prior to a user rotating the waveguide. The angle the waveguide is to be rotated is determined by the desired resulting change in polarity.

Without tools, a user may slide the movable sleeve towards the actuating position (Step 505). When the movable sleeve is moved towards the actuating position the waveguide may be coupled to the waveguide connector, thereby preventing axial movement of the waveguide relative to the waveguide connector. In some embodiments, the waveguide may be free to rotate within the waveguide connector when the waveguide is coupled to the waveguide connector. In some embodiments, Step 505 may be performed by a force provider. The force provider may be a mechanical spring, a pneumatic spring, a hydraulic spring, a magnetic spring, or an electromagnetic spring.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A waveguide connector assembly comprising:

a waveguide connector having a first end, a second end opposite the first end, and a body having a length that extends axially between the first end and the second end, the body having an interior surface and an exterior surface, the waveguide connector being configured to receive a waveguide in a first orientation or a second orientation at the first end, the second orientation being a rotation of the waveguide from the first orientation by either 45 degrees or 90 degrees to change polarizations; and a movable sleeve having a first end, a second end opposite the first end, a body extending axially between the first end and the second end, and an engaging surface, the movable sleeve being configured to slide axially along the exterior surface of the waveguide connector, the engaging surface being configured to prevent axial movement of the waveguide when the movable sleeve is in an engaged position.

2. The waveguide connector assembly of claim 1, wherein the waveguide is released from the waveguide connector when the movable sleeve is slid away from the engaged position.

3. The waveguide connector assembly of claim 2, wherein the waveguide is moved between the first orientation and the second orientation after being released from the waveguide connector.

4. The waveguide connector assembly of claim 3, wherein the waveguide is moved between the first orientation and the second orientation after the waveguide is removed from the waveguide connector.

5. The waveguide connector assembly of claim 3, wherein the waveguide is moved between the first orientation and the second orientation while the waveguide remains received by the waveguide connector.

6. The waveguide connector assembly of claim 1, further comprising a force provider configured to urge the movable sleeve towards the engaged position.

7. The waveguide connector assembly of claim 1, wherein the waveguide connector further comprises one or more bearing apertures each extending radially through the body of the waveguide connector and each configured to receive a respective bearing of one or more bearings.

8. The waveguide connector assembly of claim 7, wherein the engaging surface prevents axial movement of the waveguide by providing a radial force onto the waveguide via the one or more bearings when the engaging surface covers the one or more bearing apertures.

9. The waveguide connector assembly of claim 1, wherein the waveguide connector is further configured to receive a second waveguide in the first orientation or the second orientation at the second end of the waveguide connector.

10. The waveguide connector assembly of claim 9, further comprising:

a second movable sleeve having a first end, a second end opposite the first end, a body extending axially between the first end and the second end, and a second engaging surface, the second movable sleeve being configured to slide axially along the exterior surface of the waveguide connector, the second engaging surface being configured to prevent axial movement of the second waveguide when the second movable sleeve is in an engaged position.

11. The waveguide connector assembly of claim 10, wherein the waveguide connector further comprises an additional one or more bearing apertures, each bearing aperture extending radially through the body and each configured to receive a respective bearing of an additional one or more bearings.

12. An antenna system comprising:

an antenna;

a waveguide;

a connector assembly, the connector assembly having:

a waveguide connector having a first end, a second end opposite the first end, and a body having a length that extends axially between the first end and the second end, the body having an interior surface and an exterior surface, the waveguide connector being configured to receive the waveguide in a first orientation or a second orientation at the first end, the second orientation being a rotation of the waveguide from the first orientation by either 45 degrees or 90 degrees to change polarizations, and a movable sleeve having a first end, a second end opposite the first end, a body extending axially between the first end and the second end, and an engaging surface, the movable sleeve being configured to slide axially along the exterior surface of the waveguide connector, the engaging surface being configured to prevent axial movement of the waveguide when the movable sleeve is in the engaged position; and a bracket configured to couple the connector assembly to the antenna.

13. The antenna system of claim 12, wherein the waveguide is released from the waveguide connector when the movable sleeve is slid away from the engaged position.

14. The antenna system of claim 13, wherein the waveguide is moved between the first orientation and the second orientation after being released from the waveguide connector.

15. The antenna system of claim 12, wherein the waveguide further comprises a nesting surface on an exterior surface of the waveguide, the nesting surface configured to prevent axial movement of the waveguide when the nesting surface has been engaged.

16. The antenna system of claim 15, wherein the nesting surface comprises one or more depressions.

17. The antenna system of claim 15, wherein the nesting surface comprises one or more grooves.

18. A method of adjusting the polarization of a waveguide connector assembly comprising:

releasing a waveguide from a waveguide connector to allow free movement of the waveguide by sliding a movable sleeve on the waveguide connector away from an engaged position along an axis;

rotating a waveguide either 45 degrees or 90 degrees; and securing the waveguide to the waveguide connector to prevent free movement of the waveguide by sliding the movable sleeve towards the engaged position along the axis.

19. The method of claim 18, further comprising removing the waveguide from the waveguide connector prior to rotating the waveguide either 45 degrees or 90 degrees.

20. The method of claim 18, wherein the waveguide is rotated either 45 degrees or 90 degrees while the waveguide remains received by the waveguide connector.

* * * * *